United States Patent [19]

Clarke

[11] Patent Number: 4,903,713

[45] Date of Patent: Feb. 27, 1990

[54] CONVEYOR SYSTEM FOR ROD-LIKE ARTICLES

[75] Inventor: Peter A. Clarke, High Wycombe, England

[73] Assignee: Molins PLC, London, England

[21] Appl. No.: 373,669

[22] Filed: Jun. 29, 1989

Related U.S. Application Data

[63] Continuation of Ser. No. 168,435, Mar. 15, 1988, abandoned.

[30] Foreign Application Priority Data

Mar. 17, 1987 [GB] United Kingdom ..... 8706321
Apr. 16, 1987 [GB] United Kingdom ..... 8709263

[51] Int. Cl.[4] ..... A24C 5/35; A24C 5/14; B65G 1/00; B65G 37/00

[52] U.S. Cl. ..... 131/283; 131/282; 198/347; 198/572; 198/580

[58] Field of Search ..... 131/282, 283; 198/347, 198/572, 580

[56] References Cited

U.S. PATENT DOCUMENTS

| | | | |
|---|---|---|---|
| 3,665,933 | 5/1972 | Molins et al. | 131/283 |
| 4,149,545 | 4/1979 | Hall | 131/283 |
| 4,280,611 | 7/1981 | Molins et al. | 198/347 |
| 4,344,445 | 8/1982 | Seragnoli | 131/283 X |
| 4,507,040 | 3/1985 | Baese et al. | 131/283 X |
| 4,595,025 | 6/1986 | Wahle et al. | 131/282 X |
| 4,747,743 | 5/1988 | Dowding et al. | 198/403 |
| 4,790,422 | 12/1988 | Clarke et al. | 198/347 |
| 4,795,020 | 1/1989 | Carter et al. | 198/347 X |

FOREIGN PATENT DOCUMENTS

| | | | |
|---|---|---|---|
| 1578138 | 11/1980 | United Kingdom | 131/283 |
| 2142894 | 1/1985 | United Kingdom | 131/283 |
| 2154534 | 9/1985 | United Kingdom | 131/282 |
| 2157252 | 10/1985 | United Kingdom | 131/283 |

*Primary Examiner*—V. Millin
*Assistant Examiner*—Cheng, Joe H.
*Attorney, Agent, or Firm*—Antonelli, Terry & Wands

[57] ABSTRACT

A cigarette conveying system for connecting several makers, packers and reservoirs is arranged with cross linking conveyors (22) which allow sub-division of the system into sub-systems which can be operated independently and can therefore handle different brands. Sub-systems may be defined by activating or de-activating selected conveyors and/or closing and opening gates provided at junctions between conveyors. In a preferred arrangement the system comprises a main loop and the cross linking conveyors sub-divide the main loop into sub-loops.

23 Claims, 10 Drawing Sheets

CONVEYOR SYSTEM FOR ROD-LIKE ARTICLES

This application is a continuation of application Ser. No. 168,435, filed Mar. 15, 1988 now abandoned.

This invention relates to a conveyor system for rod-like articles, particularly a system for conveying rod-like articles of the tobacco industry, such as cigarettes or cigarette filter rods, in multi-layer stack formation.

According to one aspect of the invention a conveyor system for rod-like articles of the tobacco industry, comprises a plurality of delivery devices (e.g. cigarette making machines), a plurality of receiving devices (e.g. cigarette packing machines), conveyor means for conveying articles between said delivery devices and said receiving devices, said conveyor means defining a path for articles, and means for preventing passage of articles along at least a portion of said path at selected times, whereby when said preventing means is in operation articles may be conveyed by said conveyor means on different parts of said path and remain segregated. The system may further comprise at least one reservoir unit and in a preferred arrangement a reservoir unit is associated with every receiving device. For the avoidance of doubt the conveyor system may itself be a sub-system of a larger system including further delivery devices and/or receiving devices and/or conveyor means.

The preventing means may comprise gate means which may be physically interposed between articles, e.g. by insertion into a mass flow stream on a conveyor, and/or speed control means (e.g. means for deactivating a conveyor), and/or detection means (e.g. means for identifying whether conveyed articles are acceptable and allowing further passage only when they are: thus, where articles are conveyed in containers the containers may be coded with details of their contents).

According to another aspect of the invention a conveyor system for rod-like articles of the tobacco industry comprises a plurality of delivery devices (e.g. cigarette making machines), a plurality of receiving devices (e.g. cigarette packing machines), and conveyor means for conveying articles between said delivery devices and said receiving devices, said conveyor means including first conveying means linking a first combination comprising at least two delivery devices and at least one receiving device, said conveyor means further comprising second conveying means linking a second combination which is a sub-combination of said first combination and includes at least one delivery device and at least one receiving device, and control means for operating said conveyor means, including means for selective operation of at least part of said first and/or second conveying means, whereby articles may be conveyed within said first combination or within said second combination and when being conveyed within said second combination articles within said second combination may be prevented from mixing with articles within that part of said first combination which is not within said second combination and vice versa. One or more delivery devices and/or receiving devices may be reversible and constitute a reservoir unit. Preferably said first and second conveying means include common and non-common portions; and preferably said means for selective operation operates on a part which comprises a common portion of said first and second conveying means.

In a preferred arrangement the part of the first combination which is not part of the second combination itself forms a subcombination comprising at least one delivery device, at least one receiving device and at least one reservoir unit, and between which articles may be transferred while articles are being transferred between the devices and unit(s) of the second combination.

The first conveying means may form a closed loop or "ring main" linking suitable portions of associated units each comprising a delivery device and receiving device, and possibly also a reservoir unit. The second conveying means may in this case comprise conveyor means cross-linking the loop so that sub-loops may be formed at appropriate positions allowing sub-division of the loop so that separate portions of it may operate independently when required.

The control means typically relies on activation and deactivation of conveyors and opening and shutting of known gate devices to allow or prevent flow of articles as required.

Both aspects of the invention may be embodied in similar apparatus; and features mentioned as applicable to one aspect are applicable to the other aspect and vice versa.

A principal use envisaged for the invention is the creation of interconnected maker/packer/reservoir units in a cigarette manufacturing complex which, while allowing all of the interconnected units to communicate with each other where they are handling the same brand of cigarette, will allow ready sub-division of the units into separate sub-combinations to enable some of the units to handle different brands.

According to another aspect of the invention a filter cigarette making machine is supplied directly with filters from a filter making machine via a reservoir/delay unit. Preferably the supply is by means of a conveyor system in which the filters are conveyed in a multilayer stream. Each of the delivery devices according to the other aspects of the invention could comprise a filter cigarette making machine connected to a filter making machine and reservoir/delay unit in this way.

The invention will be further described, by way of example only, with particular reference to the accompanying diagrammatic drawings, in which.

Figure 9:
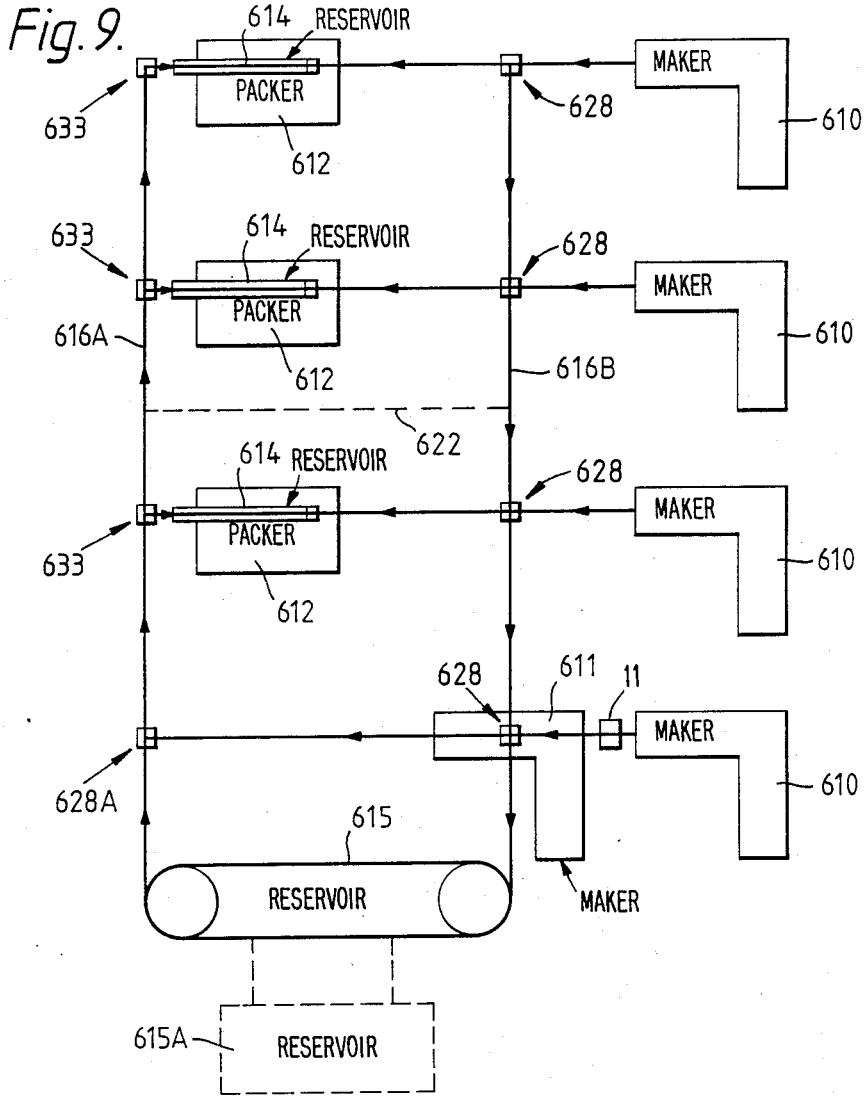
FIG. 9 is a plan view of a still further conveyor system for cigarettes.
Figure 10:
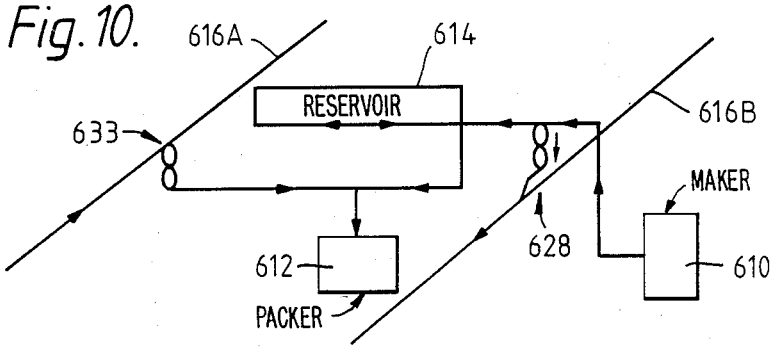
Figure 11:
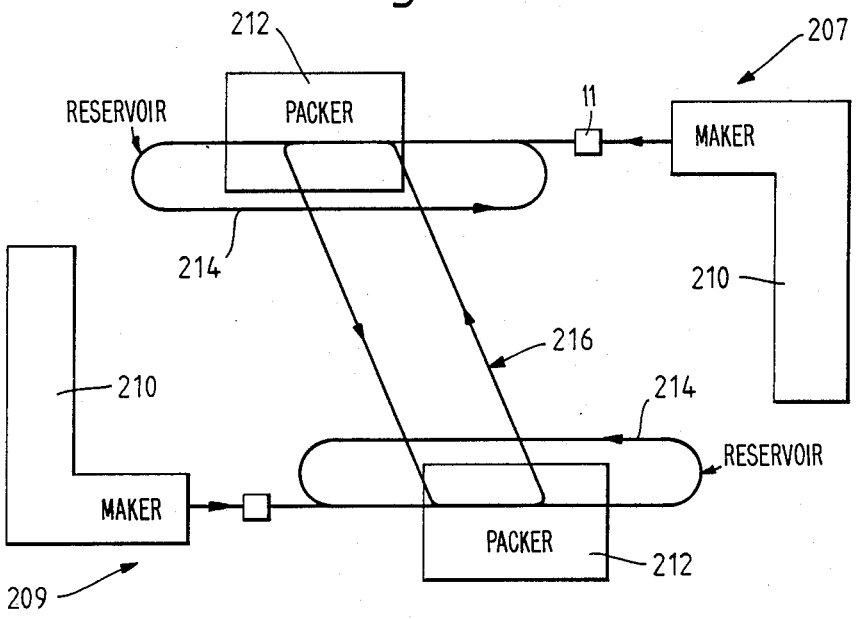
Figure 12:
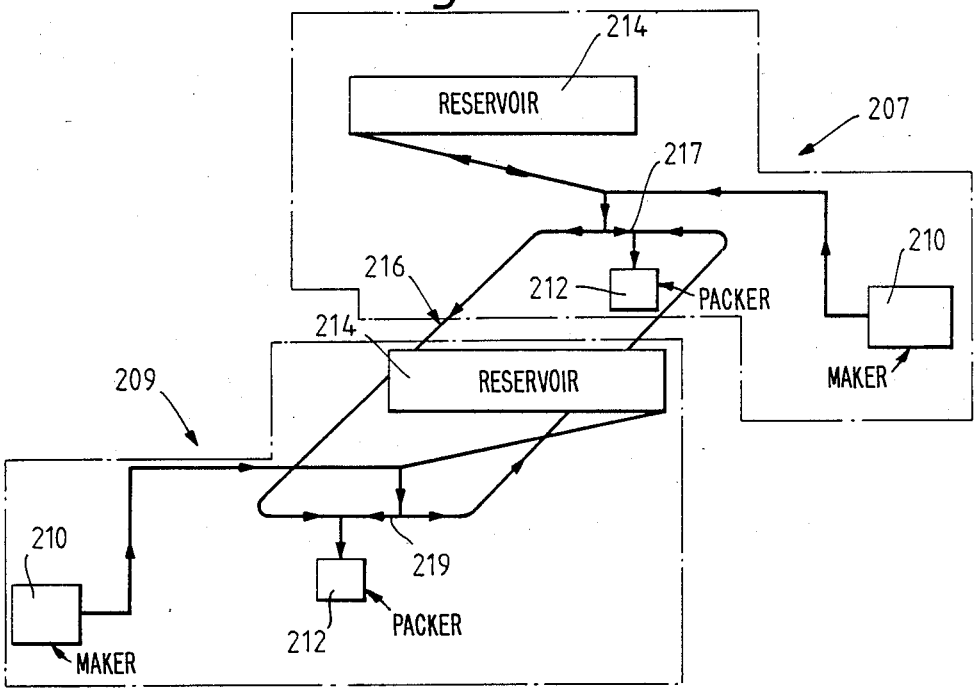
Figure 13:
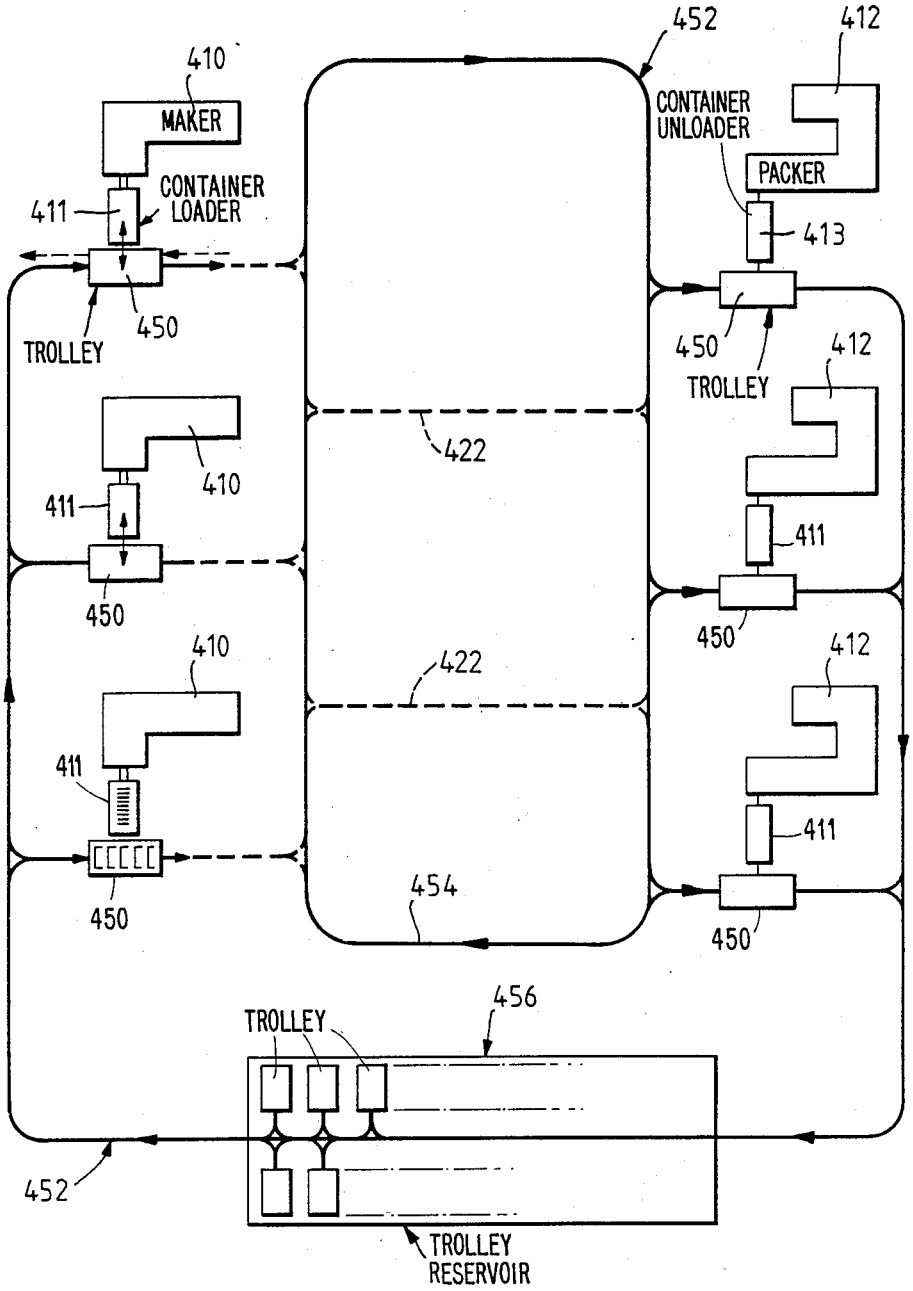
Figure 14:
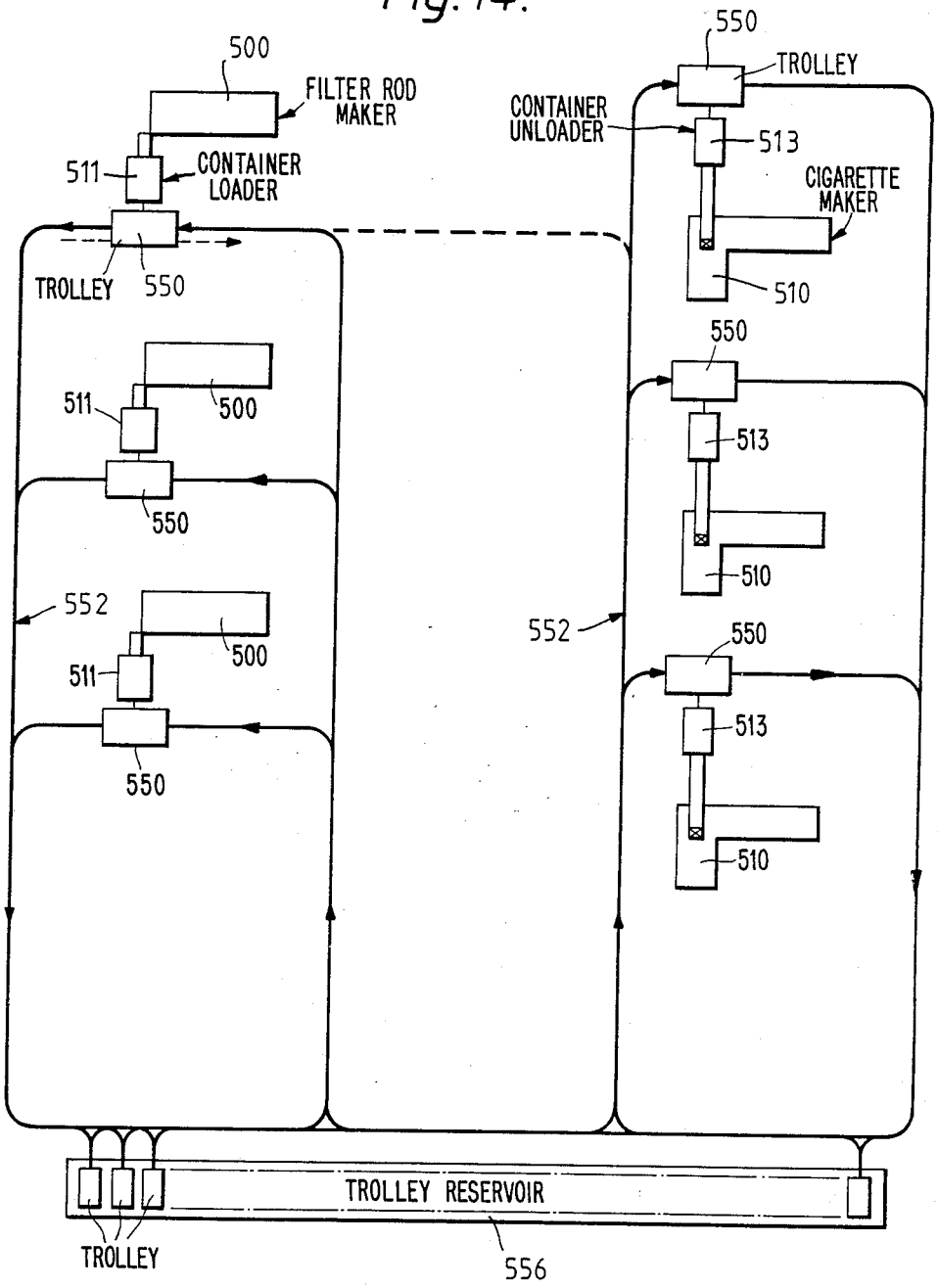
Figure 15:
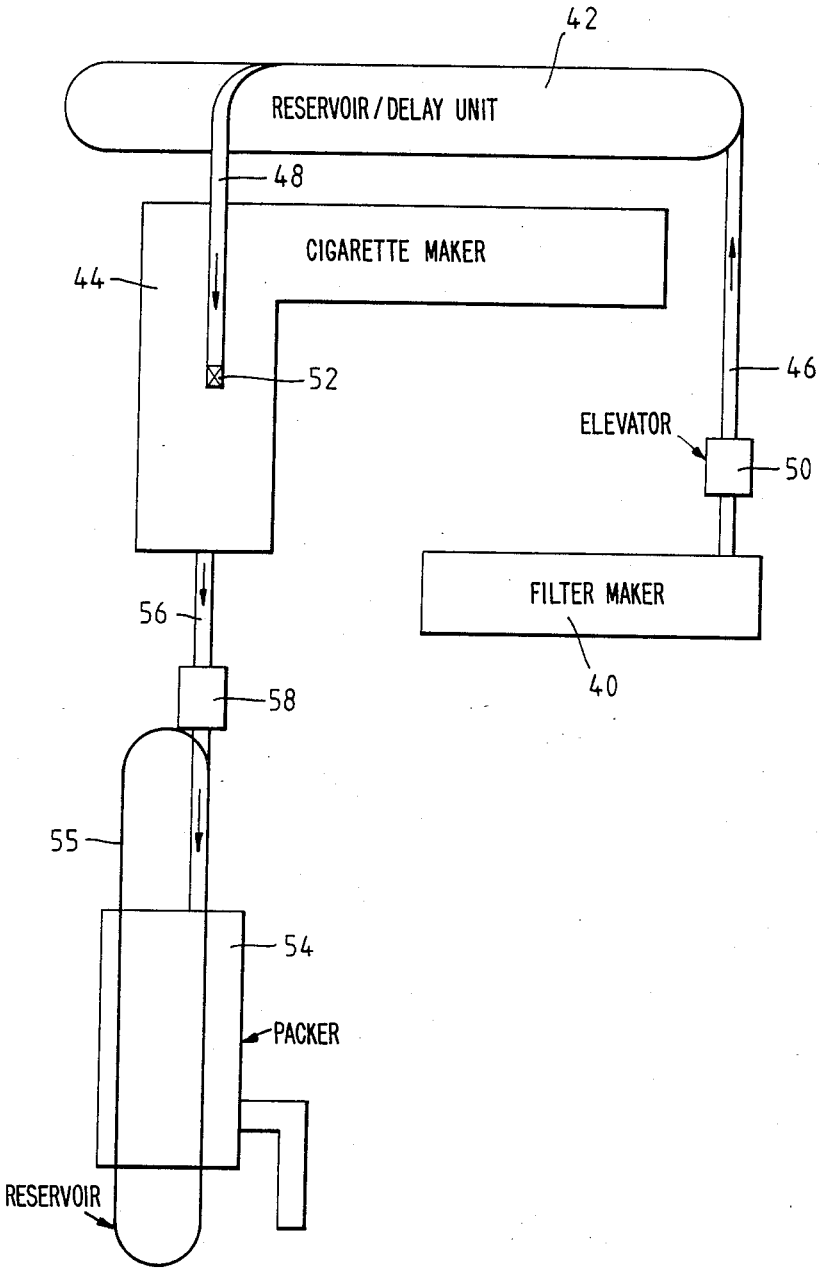

FIG. 10 is a perspective representation of part of the system of FIG. 9, FIG. 11 is a plan view of a further conveyor system for cigarettes, FIG. 12 is a perspective representation of the system of FIG. 11, FIG. 13 is a plan view of a still further conveyor system for cigarettes, FIG. 14 is a plan view of a conveyor system for filter rods, and FIG. 15 shows a filter cigarette manufacturing and packing system.

Figure 1:
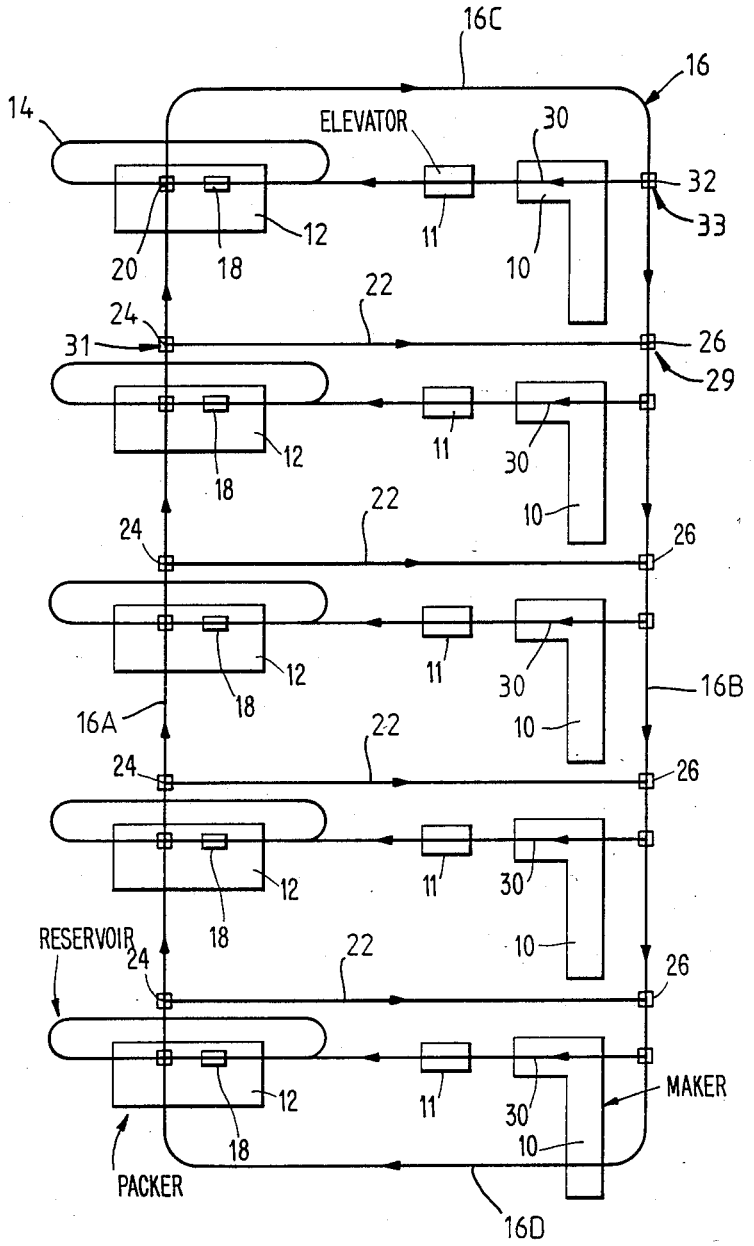
FIG. 1 is a plan view of a conveyor system for cigarettes.

FIG. 1 shows a conveyor system linking five cigarette making and packing units. Each unit comprises a cigarette making machine 10 a cigarette packing machine 12 and a cigarette reservoir unit 14. The conveyor system includes a main "ring main" conveyor 16 forming a unidirectional closed loop path around the units. As shown more clearly in FIG. 2 articles passing up elevator 11 from a making machine 10 to a packing machine 12 pass down a chute 18 at the bottom of which is an inverted T-junction from which they pass either to the packing machine 12 or to a twisted downdrop 20 connected to the conveyor 16 by way of a gated merging junction 28.

Between each of the units comprising making machine 10, packing machine 12, and reservoir 14, are cross-conveyors 22 which sub-divide the loop conveyor 16. Each conveyor 22 is unidirectional and is connected to the conveyor 16 by way of a first twisted downdrop 24 forming a gated T-junction 31 with the conveyor 16 and a second twisted downdrop 26 leading to a gated merging junction 29 with the conveyor 16.

The merging junctions 28 and 29 each comprise a downwardly-inclined path leading into the conveyor 16 from a substantially horizontal path at the bottom of the respective chute 20 or 26. Each junction 28 and 29 is provided with a gate for selectively allowing and preventing passage of articles to the conveyor 16. These gates may be substantially as disclosed in British patent specification No. 2157253A, particularly FIGS. 9 and 10 and the corresponding description thereof, to which reference is directed for details.

Gates are also provided at the T-junctions 31 between the conveyor 16 and the twisted downdrops 24 leading to conveyor 22, for selectively allowing and preventing passage of articles from the conveyor 16 to conveyor 22. Each gate at a junction 31 may take the form of any of the gates or closure devices suitable for use at a T-junction disclosed or referred to in said British patent specification No. 2157253A, to which reference is directed for details.

Conveyor sections 30 are provided which link the conveyor 16 with the output from each making machine 10 (and hence with each packing machine 12 and each reservoir 14), via further twisted downdrops 32 leading from T-junctions 33. Each of the junctions 33 may be provided with a gate similar to the gates at junctions 31.

Figure 2:
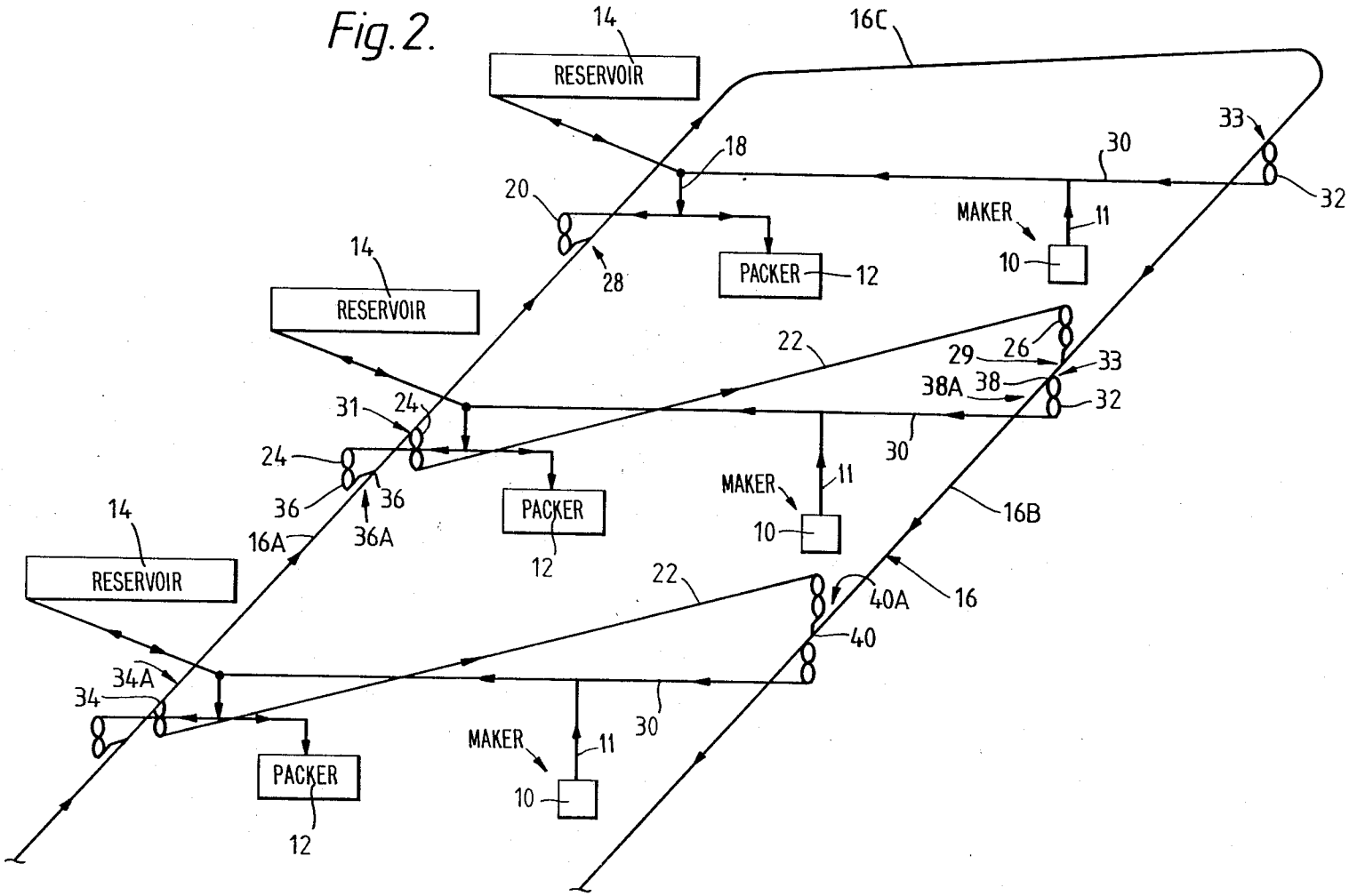
FIG. 2 is a perspective representation of part of the system of FIG. 1.

The system of FIGS. 1 and 2 allows any packing machine 12 to receive cigarettes from any making machine 10 or any reservoir unit 14, by transport around the conveyor 16. In normal circumstances, where all of the makers 10 are handling the same brand of cigarette, the conveyors 22 would be inactive and the gates at each end of the conveyors would be in their closed positions. However, if it is required to operate some of the makers on different brands, this may be achieved by activating the appropriate cross-linking conveyor 22. For example, referring to FIG. 2, the section of conveyor 16 between points 34 and 36 and the section between points 38 and 40 may be inhibited to separate the cigarettes manufactured in the upper two making machines 10 from those in the lower three machines (as viewed in FIGS. 1 and 2). Each sub-combination still comprises a closed loop by virtue of the appropriate cross-linking conveyors 22 (which are activated and the normally-closed gates at their ends opened).

It may be noted that when the system is operating with different brands there will be sections of conveyor 16 (e.g. between points 34 and 36 and between points 38 and 40) which are inactive. In order to ensure no mixing of brands these sections would normally be drained of cigarettes before operating the system as separate sub-combinations. In such circumstances there are some junctions (e.g. at 34, 36, 38 and 40) where one branch of the junction is initially void of cigarettes: this is allowed to fill naturally with cigarettes which spill over from the other branches of the junction which are in use. Since the conveyor section associated with said one branch will not be in use these cigarettes will build up and form a natural boundary for cigarettes passing through the junction between said other branches and for controlling those other cigarettes. Thus in the example referred to above such a boundary is found in the branches 34A, 36A, 38A and 40A. Alternatively, or additionally, a temporary physical boundary (e.g. a plate or other blocking insert) may be inserted in said one branch.

It may still be useful to activate one or more cross-linking conveyor 22 even within a system or sub-system where only one brand is being handled in circumstances where otherwise the required flow of cigarettes on part of conveyor 16 might exceed a maximum permissible or advisable speed. Thus the conveyors 22 may be used to provide a rate of flow between making machines 10 and/or reservoirs 14 and packing machines 12 and/or reservoirs 14 which is potentially greater than by use of conveyor 16 alone.

Control of the system, which may be by way of microprocessors, may include reservoir capacity sensing and appropriate conveyance of cigarettes to maintain the reservoirs at a desired state of fill (e.g. half full).

It may be noted that in principle recirculation of cigarettes (which may be generally regarded as the passing of cigarettes through an excessive distance on the conveyor 16 or conveyors 22 before entering a packing machine or the transfer of cigarettes from one reservoir 14 to another reservoir) by way of the conveyor section 30 is possible. This may be avoided by monitoring and controlling passage of cigarettes on this section and ensuring (by appropriate timing) that all cigarettes passing along the section are delivered into the packing machine and not passed back onto the conveyor 16.

The conveyor 16 may be regarded as comprising a first conveyor 16A for receiving excess cigarettes from the making machines 10 or reservoirs 14 and a second conveyor 16B for delivering excess cigarettes to the packing machine 12 or reservoirs 14. The conveyor 16B is at a higher level than the conveyor 16A. Conveyors 16C and 16D linking conveyors 16A and 16B are therefore inclined: a typical maximum slope would be about 10°. The conveyors 16A and 16C, 16C and 16B, 16B and 16D, and 16D and 16A are connected by curved conveyors, e.g. comprising laterally flexible conveyors of the type disclosed in British Pat. No. 1299174 or a turning arrangement similar to that disclosed in U.S. Pat. No. 4572352. It will be understood that the conveyors 16A, 16B etc each comprise separate sections, e.g. extending between junctions, movable at different speeds as required and generally as determined by sensors at the junctions.

Figure 3:
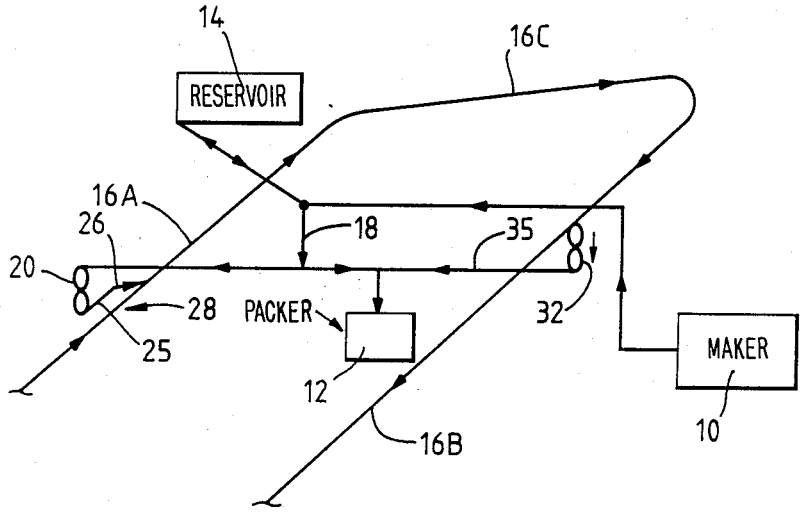
FIG. 3 is a perspective representation of part of a modified system.

FIG. 3 shows a modified system in which the makers 10 are repositioned and so that the conveyor sections 30 are replaced by a conveyor section 35. Note that in this arrangement recirculation of cigarettes from the conveyor 16B to the reservoir 14 is not possible (because, unlike conveyor section 30, conveyor section 35 is separated from the reservoir 14 by downdrop 18). Each junction 28 comprises a horizontal conveyor section 25 and an inclined merging conveyor section 26.

Figure 4:
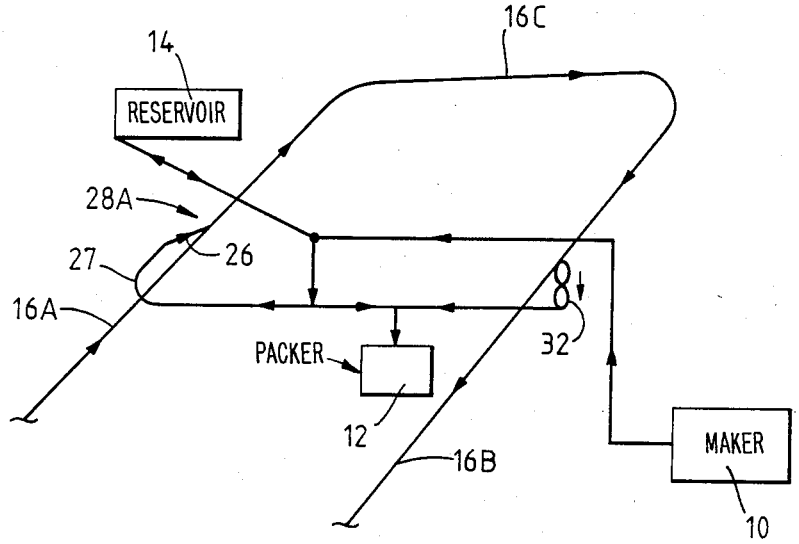
FIG. 4 is a perspective representation of part of another modified system.

FIG. 4 shows another modified system, similar to that of FIG. 3, except that a modified junction 28A is provided, comprising a laterally curved conveyor section 27 leading to an inclined merging conveyor section 26 as before. Since the twisted downdrop 20 is omitted the difference in height between conveyors 16A and 16B may be less. The junctions 29 in the system of FIGS. 1 and 2 may be modified to be similar to the junction 28A.

In the systems of FIGS. 1–4 the reservoirs 14 comprise units in which the articles are stored in a continuous mass flow stream (e.g. Molins OSCAR). In principle these can readily be replaced by reservoir units in which articles are stored in containers (e.g. Molins MATCH), or any other reversible reservoir. Again, in principle the reservoir units need not all be reversible: for example container loading devices and container unloading devices could be connected to the system at separate locations.

Figure 5:
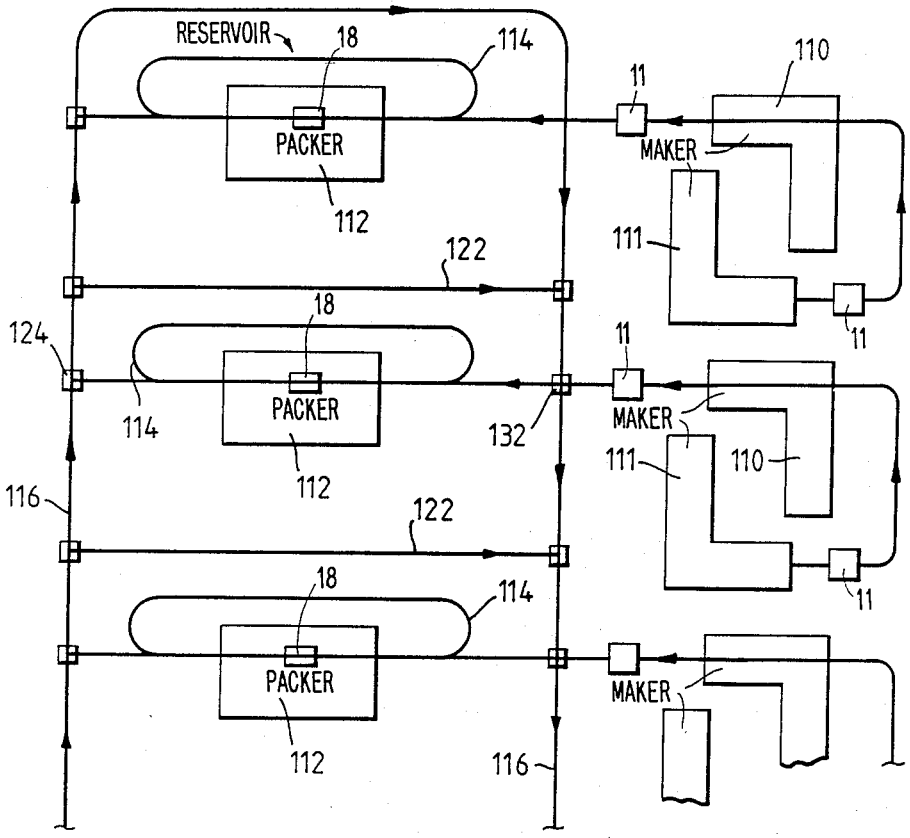
FIG. 5 is a plan view of a further conveyor system for cigarettes.
Figure 6:
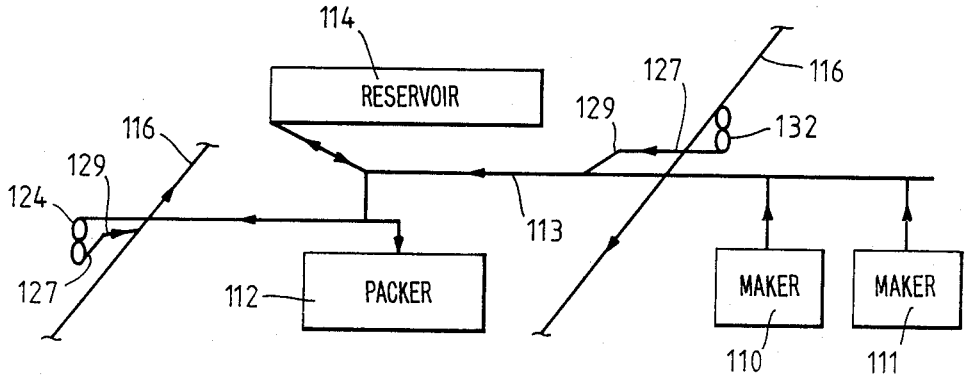
FIG. 6 is a perspective representation of part of the system of FIG. 5.

The system shown in FIGS. 5 and 6 is similar to that of FIGS. 1 and 2 but with the following differences. Each packing machine 112 is linked to two making machines 110, 111 as well as to a reservoir unit 114. As shown particularly in FIG. 6, the connections to the closed loop path 116 are by way of twisted downdrops 132 and 124, leading to short horizontal conveyor sections 127 and inclined sections 129 which merge respectively into conveyors 116 and 113. The system of FIGS. 5 and 6 could be modified to provide connections similar to those provided in FIG. 3 or FIG. 4.

Figure 7:
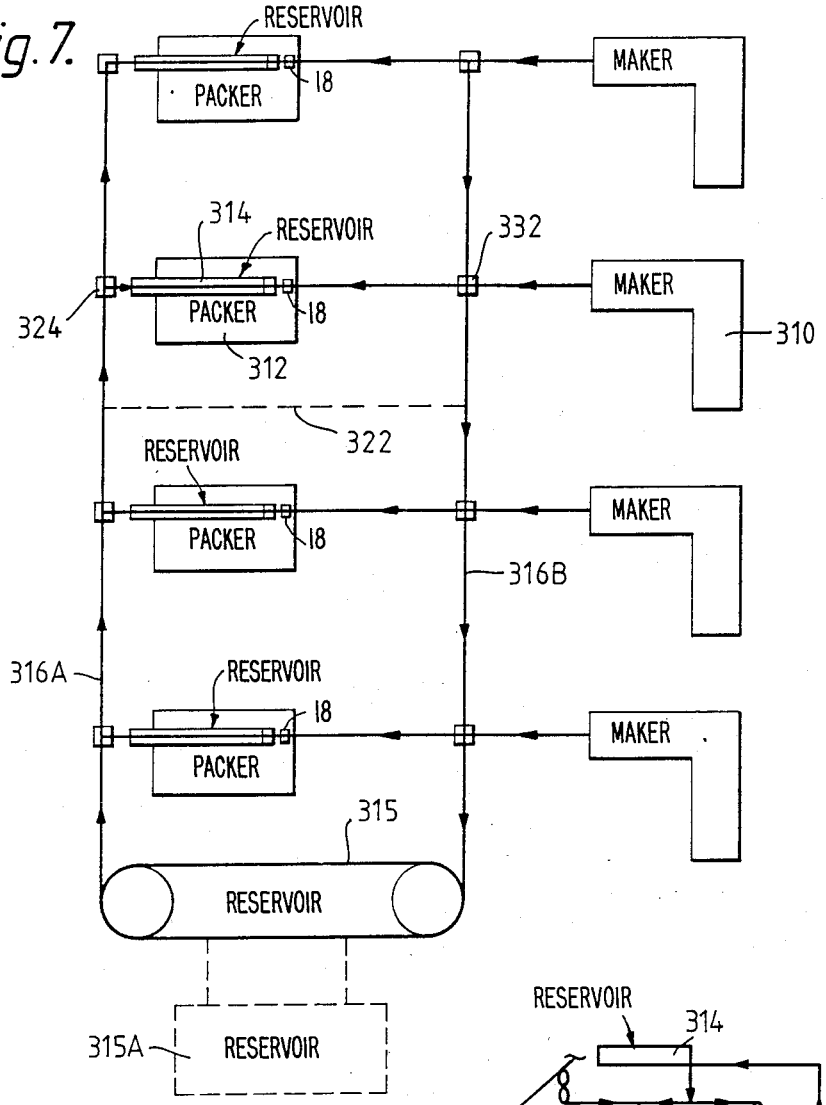
FIG. 7 is a plan view of a still further conveyor system for cigarettes.
Figure 8:
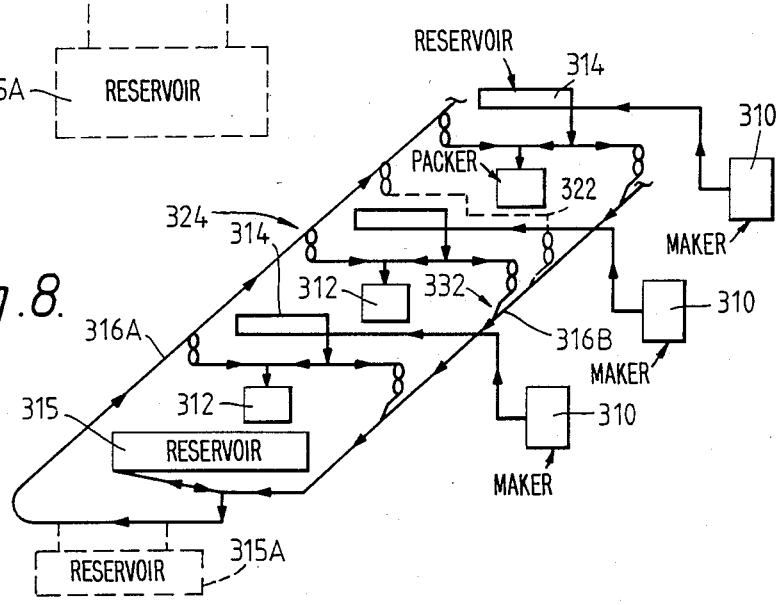
FIG. 8 is a perspective representation of part of the system of FIG. 7.

FIG. 7 shows another system similar to that of FIGS. 1 and 2 in that it employs gated junctions 324, 332 and a cross-linking conveyor 322. The system has a number of units each comprising a cigarette making machine 310, cigarette packing machine 312, and a reservoir 314. The reservoir 314 is of relatively low capacity (e.g. typically under 5,000 cigarettes) and may comprise a straight reversible conveyor section, as in Molins MOLAR. The units are interconnected by unidirectional conveyor flow lines 316A and 316B. These may be connected at their ends to form a closed loop path. At one end the lines 316A and 316B are connected to a relatively high capacity reservoir 315 and/or 315A. This could comprise Molins OSCAR (e.g. as disclosed in British Pat. No. 1299174) and/or Molins MATCH (e.g. as disclosed in British Pat. No. 2171971). The arrangement of conveyors and junctions 324, 332 which connect the lines 316A, 316B to each unit is shown in FIG. 8. The conveyor 322 is connected to the conveyors 316A and 316B by gated junctions similar to the junctions 324 and 332. The junctions 332 could be replaced by junctions similar to the junction 28A of FIG. 4.

FIGS. 9 and 10 show a still further system, again having basic similarities with the system of FIGS. 1 and 2, and also somewhat similar to the system of FIGS. 7 and 8. The system comprises making machines 610, packing machines 612, relatively small capacity reservoirs 614, and a relatively large capacity reservoir 615 and/or 615A. The reservoir 615 may be similar to Molins OSCAR; the reservoir 615A may be similar to Molins MATCH. The various units of the system are interconnected by a closed loop path comprising unidirectional conveyors 616A and 616B. The forms of the gated junctions 633 and 628 are shown in FIG. 10. The junction 628A may be similar in form to the junction 628. An intermediate cross-linking conveyor 622 links the conveyors 616A and 616B; the junctions at its ends may be respectively similar to the junctions 633 and 628.

Each of the systems of FIGS. 5 and 6, FIGS. 7 and 8, and FIGS. 9 and 10 may be operated in a similar way to that of FIGS. 1 and 2, to convey cigarettes in separate sub-systems with no mixing of the cigarettes in the sub-systems or, alternatively, to convey cigarettes between all units in the system. The division of a system into separately usable sub-systems is useful other than for handling different types or brands of cigarettes: for example it allows continued operation of at least some of the units linked in a system while others are undergoing repair or maintenance.

FIGS. 11 and 12 show a system including only two maker/packer/reservoir units 207, 209 in which each maker 210, and each reservoir 214 may supply either packer 212 but cigarettes cannot pass from one reservoir to the other reservoir. This is achieved by providing a closed loop path 216 for cigarettes with control of direction of feed of cigarettes as indicated by the arrows in FIG. 12. Separate brands of cigarettes could be handled by the different maker/packer/reservoir units 207, 209 by deactivating the conveyors of path 216 with the exception of portions 217, 219 (see FIG. 12).

FIG. 13 shows a system interconnecting cigarette making machines 410 and cigarette packing machines 412 in which cigarettes are conveyed in containers in trolleys. For this purpose each cigarette making machine 410 has a container filling station 411 and each cigarette packing machine 412 has a container unloading station 413. Trolleys 450 are moved on a path 452 which includes a closed loop path portion 454 and a buffer reservoir or store portion 456. The trolleys 450 and/or the containers may be coded with information relating at least to their contents using a system (including e.g. transponders or magnetically coded strips) similar to that disclosed in British Pat. No. 2188601, to which reference is directed. In this way trolleys conveying different brands of cigarettes may be conveyed and/or stored on the path 452, each container unloading station 413 being programmed to accept only those trolleys and/or containers bearing a code corresponding to that of cigarettes currently being handled by the associated packing machine 412. The path portion 454 could include cross-linking path portions 422 sub-dividing the closed loop path into separately usable parts.

FIG. 14 shows a system having similarities with that of FIG. 13 but adapted for conveying filter rods between filter rod making machines 500 and filter cigarette making machines 510. Each machine 500 has an associated container filling station 511 and each machine 510 has an associated container unloading station 513. The filter rods are loaded into containers at the filling stations 511 and transported in trolleys 550 on a path 552 which passes the unloading stations 513. As before, each container and/or trolley 550 is coded at the station 511 and each station 513 has appropriate read heads so that only containers or trolleys with acceptable contents are unloaded. The path 552 includes a buffer reservoir 556. The path 552 and in particular the reservoir 556 may constitute a delay line to ensure adequate curing of filter rods before unloading. For this purpose the containers and/or trolleys 550 may be given a time code at the station 511 and the stations 513 may be programmed to accept only containers and/or trolleys having codes indicating that an adequate delay since manufacture has occurred. Each of the making machines 500 and 510 is operable independently of the other, the conveyor path 552 (for trolleys 550) extending between them being capable of conveying and maintaining separate different types of filter rods.

FIG. 15 shows a filter making machine 40, filter reservoir/delay unit 42, and filter cigarette making machine 44 linked by mass flow conveyors 46, 48, on which filters are conveyed in multi-layer stack formation. The conveyor 46 includes an elevator 50 and the conveyor 48 a downdrop or chute 52. The filter cigarette making machine 44 is linked to a packing machine 54 and reservoir unit 55 by way of a conveyor 56, which includes an elevator 58.

I claim:

1. A conveyor system for rod-like articles of the tobacco industry, comprising a plurality of delivery device, a plurality of receiving devices, conveyor means for conveying said articles between said delivery devices and receiving devices, said conveyor means defining a path for conveying said articles, and means for preventing passage of said articles along at least a portion of said path at selected times, whereby when said preventing means is in operation said articles can be conveyed by said conveyor means on different parts of said path and remain segregated, wherein said delivery devices and receiving devices are arranged in a plurality of combinations, each of said combinations comprising at least one delivery device and at least one receiving device, said conveyor means including first means for conveying said articles on a relatively direct path between said delivery devices and receiving devices in each of said combinations and second means for conveying said articles between different combinations, said second means including a closed loop path which is separate from any of said direct paths.

2. A conveyor system as claimed in claim 1, wherein said conveyor means is arranged so that said articles can be conveyed between a first combination of at least three devices including a delivery device and a receiving device when said preventing means is not in operation, and separately between a second combination including a delivery device and a receiving device and said second combination is a subcombination of said first combination when said preventing means is in operation.

3. A conveyor system as claimed in claim 2, including a third combination, said third combination is a subcombination of said first combination, and includes a delivery device and a receiving device, said conveyor means being operable to convey said articles separately between said delivery devices and receiving devices of said second and third combination when said preventing means is in operation.

4. A conveyor system as claimed in claim 2, wherein said first combination comprises each of the delivery devices and receiving devices, and the conveyor means includes means for conveying articles to each of said receiving devices from each of said delivery devices.

5. A conveyor system as claimed in claim 1, wherein the conveyor means comprises means for conveying a stream of articles in multi-layer stack formation and said preventing means comprises a separating device which may be activated to separate said stream on said conveyor means.

6. A conveyor system as claimed in claim 5, wherein said separating device is located within the region of a junction between portions of said conveyor means which extend in different directions.

7. A conveyor system as claimed in claim 5, wherein said conveying means includes a junction between a substantially horizontal conveyor portion and a substantially vertical conveyor portion, and a separating device extensible across the top of said vertical portion at said junction.

8. A conveyor system as claimed in claim 5, wherein said conveying means includes a junction between a downwardly inclined conveyor portion and a substantially horizontal conveyor portion, and a separating device operable in said inclined portion adjacent said junction.

9. A conveyor system as claimed in claim 1, wherein at least one of said delivery devices and receiving devices is reversible and comprises a reservoir unit.

10. A conveyor system is claimed in claim 1, including at least one path extending across said closed loop path and forming junctions with said closed loop path at each of its ends.

11. A conveyor system as claimed in claim 10, wherein said at least one path includes a portion which is coincident with part of one of said relatively direct path.

12. A conveyor system for rod-like articles of the tobacco industry, comprising a plurality of delivery devices, a plurality of receiving devices, conveyor means for conveying said articles between said delivery devices and said receiving devices, said conveyor means defining a closed loop path for conveying said articles and including means for conveying a stream of said articles in multi-layer stack formation, and means for preventing passage of said articles along at least a portion of said closed loop path at selected times and including at least one separating device which can be activated to separate a stream of said articles on said conveyor means, whereby when said preventing means is in operation said articles can be conveyed by said conveyor means on different parts of said closed loop path and remain segregated, wherein said conveyor means includes a conveyor section extending across said closed loop path to form with a portion of said closed loop path thereof at least one sub-loop.

13. A conveyor system as claimed in claim 12, wherein said separating device is located within the region of each junction of said conveyor section with said closed loop path.

14. A conveyor system for rod-like articles of the tobacco industry, comprising a plurality of delivery devices, a plurality of receiving devices, conveyor means for conveying said articles between said delivery devices and said receiving devices, said conveyor means defining a closed loop path for conveying said articles and including means for conveying a stream of said articles in multi-layer stack formation, and means for preventing passage of said articles along at least a portion of said closed loop path at selected times and including at least one separating device which can be activated to separate said stream of articles on said conveyor means, whereby when said preventing means is in operation said articles can be conveyed by said conveyor means on different parts of said closed loop path and remain segregated, wherein said closed loop path includes a first section containing first junction for receiving articles from delivery devices and a second section containing second junctions for delivering said articles to receiving devices.

15. A conveyor system as claimed in claim 14, wherein said first and second sections respectively include portions which are substantially parallel and at different levels.

16. A conveyor system as claimed in claim 15, including a conveyor section extending across said closed loop path between said first and second sections and includes at least one twisted downdrop.

17. A conveyor system for rod-like articles of the tobacco industry, comprising a plurality of delivery devices, a plurality of receiving devices, conveyor means for conveying said articles between said delivery devices and said receiving devices, said conveyor means including first conveying means linking a first combination comprising at least two delivery devices and at least one receiving device, said conveyor means further comprising second conveying means linking a second combination which is a sub-combination of said first combination and includes at least one delivery device and at least one receiving device, and control means for operating said conveyor means, including means for selective operation of at least part of at least one of said first and second conveying means, whereby said articles can be conveyed within said first combination or within said second combination, and when being conveyed within said second combination, said articles within said second combination can be prevented from mixing with said articles within that part of said first combination which is not within said second combination and vice versa, wherein said first conveying means includes a closed loop path and said second conveying means comprising a conveyor extending across said closed loop path so that sub-loops are formed with a portion of said closed loop path to allow separate portions of said closed loop path to operate independently.

18. A conveyor system as claimed in claim 17, wherein the part of the first combination, which is not part of the second combination itself, forms a sub-combination comprising at least one delivery device and at least one receiving device, and between which delivery device and receiving device said conveyor means is arranged to transferred between said delivery devices and receiving devices of said second combination.

19. A conveyor system for rod-like articles of the tobacco industry, comprising a plurality of delivery devices, a plurality of receiving devices, conveyor means for conveying said articles between said delivery devices and said receiving devices, said conveyor means defining a path for conveying said articles, and means for preventing passage of articles along at least a portion of said path at selected times, whereby when said preventing means is in operation said articles can be conveyed by said conveyor means on different parts of said path and remain segregated, wherein said path for conveying said articles includes spaced substantially horizontal sections and a transfer conveyor extending between said sections and forming therewith first and second junctions, respectively, at the ends of said transfer conveyor, said first junction comprising means for transferring said articles downwards from one of said sections to said transfer conveyor, and said second junction comprising means for transferring said articles downwards from said transfer conveyor to the other of said sections.

20. A conveyor system as claimed in claim 19, wherein said first junction comprises a T-junction and said second junction includes a downwardly inclined merging portion.

21. A conveyor system as claimed in claim 20, wherein said preventing means includes a separating device in the region of each of said first and second junctions.

22. A conveyor system as claimed in claim 19, wherein said conveyor means includes means for conveying articles directly between a delivery device and a receiving device by way of said transfer conveyor, and for conveying articles indirectly between said devices by way of said sections.

23. A conveyor system as claimed in claim 22, wherein said sections form a closed loop path.

* * * * *